US005487195A

United States Patent [19]

Ray

[11] Patent Number: 5,487,195

[45] Date of Patent: Jan. 30, 1996

[54] PATIENT LIFTING AND TRANSPORTING APPARATUS

[76] Inventor: Donald A. Ray, 396 Ranger La., S. Charleston, W. Va. 25309

[21] Appl. No.: 20,977

[22] Filed: Feb. 22, 1993

[51] Int. Cl.[6] ..... A61G 7/10

[52] U.S. Cl. ..... 5/83.1; 5/86.1; 5/89.1

[58] Field of Search ..... 5/81.1, 83.1, 85.1, 5/86.1, 89.1

[56] References Cited

U.S. PATENT DOCUMENTS

| | | | |
|---|---|---|---|
| 2,523,891 | 9/1950 | Wallstrom | 5/89.1 X |
| 2,663,031 | 12/1953 | Kalthoff | 5/89.1 |
| 2,975,434 | 3/1961 | Butler et al. | 5/86.1 |
| 3,099,020 | 7/1963 | Garfield et al. | 5/81.1 |
| 3,131,404 | 5/1964 | Bowers et al. | 5/86.1 |
| 5,181,289 | 1/1993 | Kassai | 5/83.1 X |

FOREIGN PATENT DOCUMENTS

| | | | |
|---|---|---|---|
| 8700040 | 1/1987 | WIPO | 5/86.1 |

*Primary Examiner*—Michael F. Trettel
*Attorney, Agent, or Firm*—George J. Neilan

[57] ABSTRACT

Apparatus for lifting and transporting a prone patient comprising a mobile base frame that may extend under the patient's bed, a vertical support structure mounted along one side of the base frame, a pair of cooperating patient supporting plates connected to the support structure, the first supporting plate is horizontally oriented and may be lowered onto the bed and slid partially under a prone patient who has been rolled slightly to the side away from the support structure, after rolling the patient in the opposite direction towards the support structure and upon the first supporting plate, the second supporting plate is pivoted downwardly onto the bed into alignment with the first supporting plate, and the patient is rolled away from the support structure onto the second supporting plate. A sling may assist positioning the patient relative to the supporting plates.

4 Claims, 2 Drawing Sheets

PATIENT LIFTING AND TRANSPORTING APPARATUS

FIELD OF THE INVENTION

The present invention relates to apparatus for lifting and transporting a nonambulatory patient. The apparatus supports the patient in a prone position.

BACKGROUND OF THE INVENTION

Many devices have been proposed to assist hospital personnel to lift nonambulatory patients, transport the patients, and lower patients onto beds. Attempts to lift patients by nurses etc. without mechanical aid have often resulted in back injuries for the workers.

Prior art devices have had limited success, particularly with heavy patients and/or patients whose injuries require that the patients be kept relatively immobile.

SUMMARY OF THE INVENTION

It is a primary object of the invention to provide an improved apparatus for lifting a prone patient off of a bed in a secure manner, and subsequently returning the patient to the bed, e. g., after the bed is changed, or after the patient has been transported to and from another area of the hospital.

Another object of the invention is to provide such patient lifting and transporting apparatus that can be operated safely by a single attendant.

Other objects, features and advantages of the invention will become more apparent as this description proceeds.

The apparatus of the invention includes a wheeled, mobile base frame that can be rolled up to and extend under a patient's bed from one side. A vertical support structure extends upwardly from one side of the base frame to above the bed. A pair of elongated, cooperating patient supporting plates are connected to the support structure. The first supporting plate is held horizontally and may be lowered vertically onto the bed. After rolling the patient slightly to the side away from the support structure; the first supporting plate is slid under the patient. The patient is then rolled in the opposite direction onto the patient's other side. The second supporting plate which has been in an upper inoperative position, is now pivoted downwardly to an operative position on the bed in alignment and contiguous to the first supporting plate. The patient is then rolled back to a supported position on both supporting plates. A sling may be used to assist in rolling and positioning the patient relative to the supporting plates. Pneumatic or similar lifting means may now lift the two supporting plates and the patient off of the bed. The base frame is now rolled away from the bed. The patient may be transported to another area of the hospital for treatment and/or the bed linens may be changed. To return the patient to the bed, the above described procedure is reversed.

DETAILED DESCRIPTION OF THE INVENTION

Figure 1:
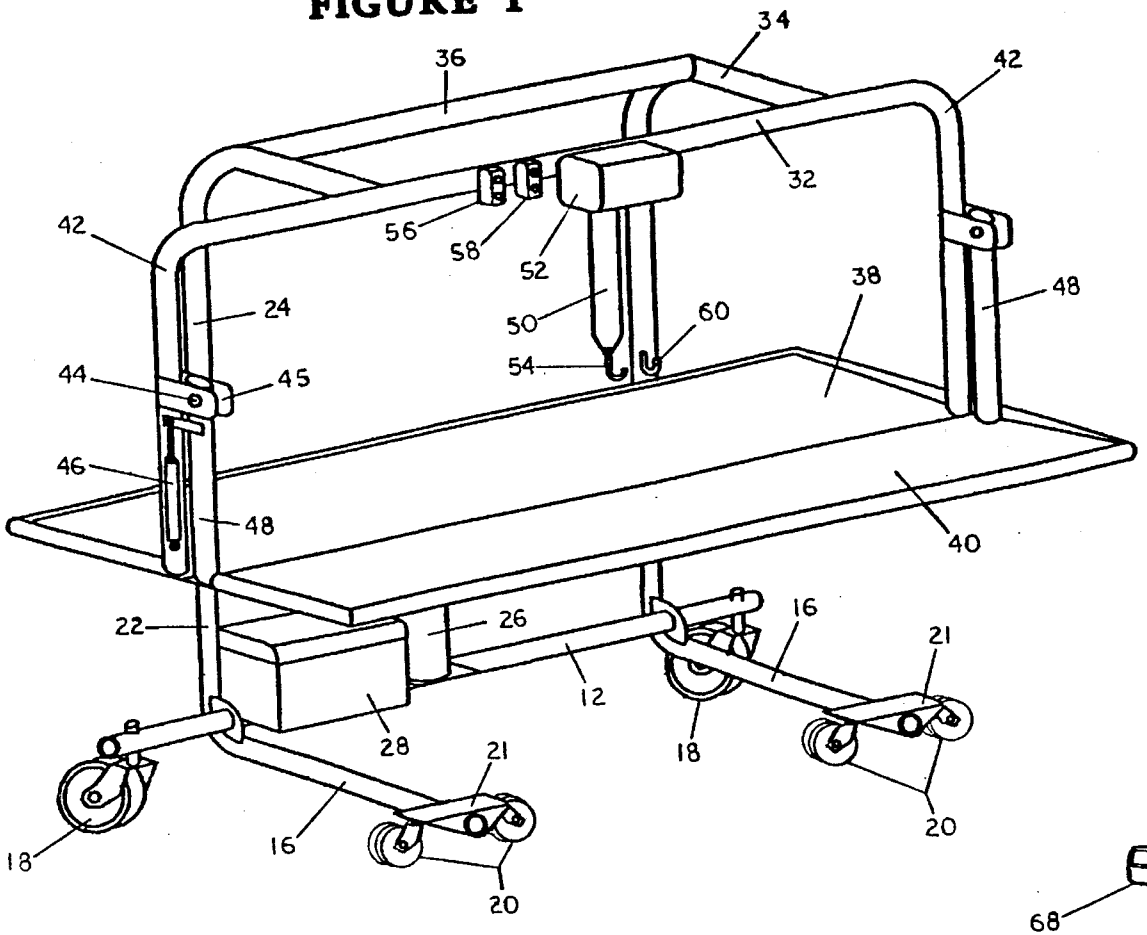
FIG. 1 is a perspective view of a presently preferred embodiment of the invention.

Referring to the drawings and more particularly to FIG. 1; the presently preferred embodiment of my invention includes a mobile base frame 10 which includes a longitudinal tubular frame member 12 connected by a pair of cross members 16. Mobility is provided by two large caster wheels 18 on the underside of frame member 12 and by two pairs of smaller wheels 20 on wheel housings 21 at the ends of cross members 16. The pairs of wheels 20 provide stability and the spacing between the wheels of each pair is useful in passing over cracks, for example, when entering or leaving an elevator. Customary when locking devices, not shown, may be provided.

A vertical support structure includes a pair of fixed tubular posts 22 attached to frame member 12, and a sliding support frame that includes a pair of telescoping tubular support members 24 disposed around posts 22. The posts 22 are preferably integral extensions of frame members 16. These parts are preferably formed of an L shaped bent hollow tubing of cylindrical crosssection. The tubing may be coated with chrome or plastic.

The sliding support frame is raised and lowered as desired by a lifting actuator 26 such as a pneumatic cylinder. The base of actuator 26 is mounted on frame member 12 between the posts 22. The upper arm 27 of the actuator is connected to the sliding frame. A battery 28 positioned on frame member 12 powers the actuator 26. In some applications of the invention, such as in an operating room that has gases that might be ignited by a spark; the battery would not be used, and the actuator would be a mechanical screw or the like.

The sliding frame also includes a main horizontal support member 32, a pair of cross pieces 34 that are integral extensions of the telescoping support members 24 and that are welded to main support member 32, and a horizontal brace 36. The brace 36 is parallel to main support member 32 and is welded at its ends to telescoping support members 24.

A pair of cooperating patient supporting plates 38 and 40 are mounted on the sliding frame. Supporting plate 38 is fixed in an essentially horizontal position on the sliding frame by being bolted to telescoping support members 24. The supporting plate 38 is given greater strength by spring steel braces 39 on its underside. Supporting plate 38 is also attached in position at its side adjacent supporting plate 40 by vertical support members 42 that are downturned integral extensions of the main support member 32.

Figure 3:
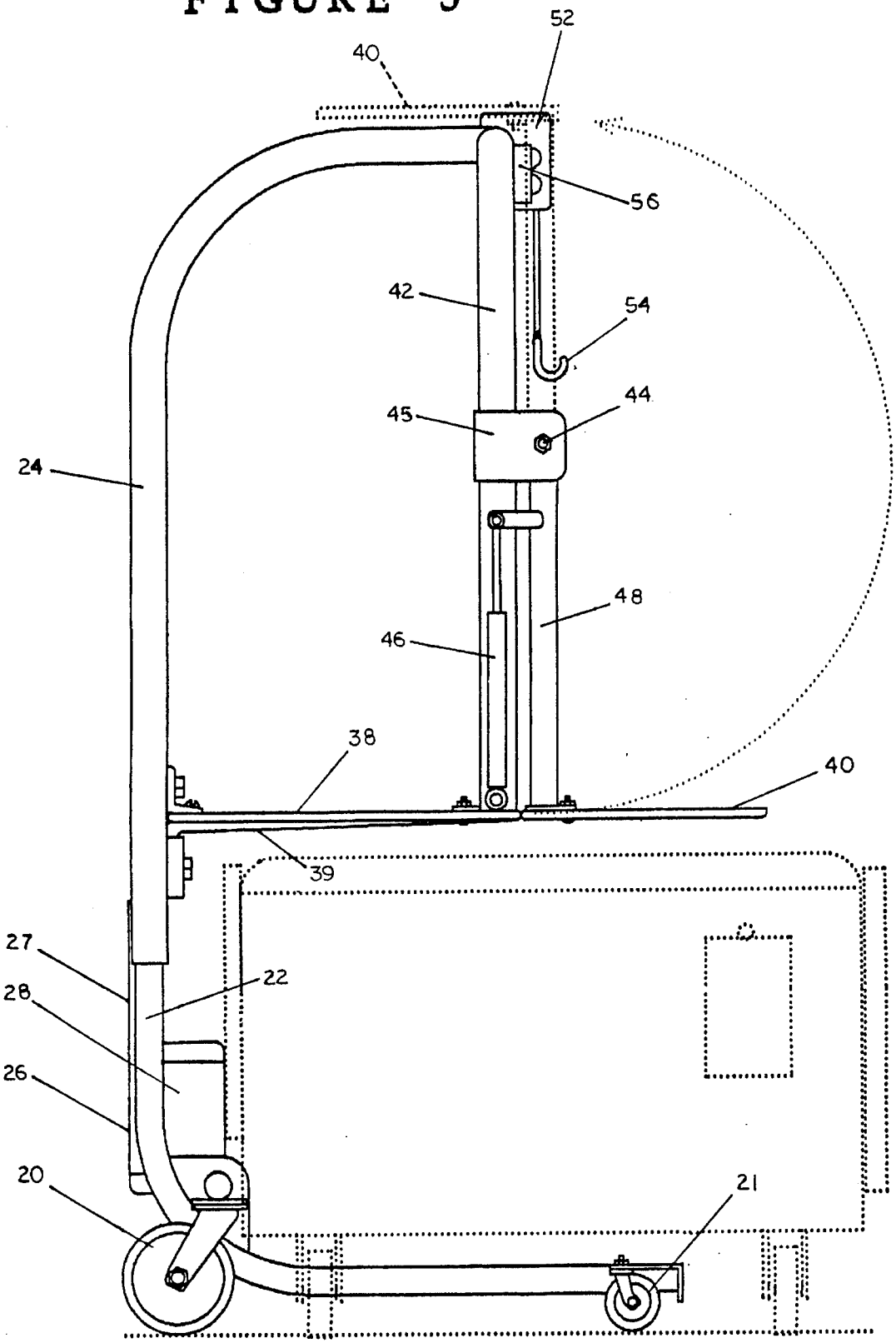
FIG. 3 is a side view of the embodiment of FIG. 1 shown positioned relative to a conventional hospital bed.

The patient supporting plate 40 is mounted for pivotable movement about pivot pins 44 in brackets 45 on the vertical support members 42 from an upper, inoperative position above main support member 32, as shown in dash lines in FIG. 3, to an operative position, shown in full lines, in alignment with and contiguous to the supporting plate 38. The pivotable movement of supporting plate 40 is actuated by a pair of pressurized cylinders 46. The cylinders 46 are attached at their lower ends to opposite ends of the supporting plate 38, and are attached at their upper ends to pivot arms 48 which connect the supporting plate 40 to the pivot pins 44.

The length of supporting plates 38 and 40 is sufficient to accomodate a prone patient of customary height and to fit upon the bed.

To assist an attendant in positioning a patient, a strap 50 is provided. Strap 50 is raised and lowered by a winch 52 located on main support member 32. The strap 50 has at its free a hook 54.

Figure 2:
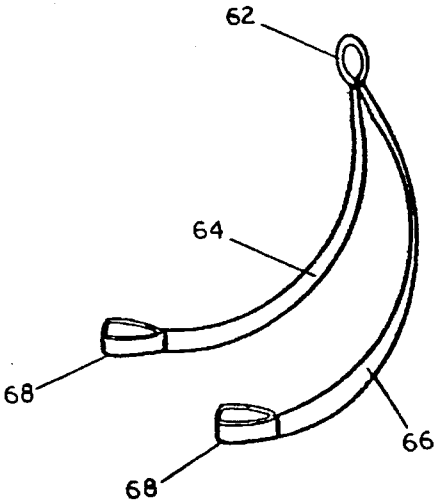
FIG. 2 is a perspective view of a patient engaging sling used with the FIG. 1 apparatus.

Referring to FIG. 2, a sling assembly is shown for attachment to the strap 50. A loop 62 is designed to engage the hook 54 on strap 50. A pair of sling sections 64 and 66 are adapted to be slipped under a patient, for example, one under the shoulders and the other under the buttocks. Loops 68 at the ends of sling sections 64 and 66 may be used as hand grips by the attendant. The sling sections are then pulled over to the vertical support structure and secured by attaching loops 68 to hooks 60 on support members 24, or fastened in other suitable manner.

Control switches 56 and 58 located on main support member 32 control operation of lifting actuator 26 and winch 52, respectively. These controls are positioned so that an attendant may operate the controls while observing the position of the patient, and the positions of supporting plates 38 and 40. The apparatus may be operated by a single attendant, with good control over the patient.

In operation, the patient lifting and transporting apparatus of the invention is rolled to the side of a patient's bed. With supporting plate 38 elevated above the top of the bed and with supporting plate 40 in its upper inoperative position; the mobile base frame is rolled under the bed. The horizontal suporting plate 38 is then lowered via actuator 26. The patient is rolled slightly away from the apparatus so that the apparatus may be moved further towards the patient so that supporting plate 38 may be slipped several inches under the patient. The patient is then rolled back partially onto supporting plate 38. Sling sections 64 and 66 may be passed under the patient. After attaching loop 62 to hook 60 on sling 50 and attaching loops 68 to hooks 60; winch 52 is used to roll the patient towards the support structure, and to raise the patient a short distance off the bed. Supporting plate 38 is now elevated off the bed and beneath the patient by actuator 26. Supporting plate 40 may now be pivoted downwardly by cylinders 46 to its operative position contiguous to supporting plate 38. Elevation of the patient is necessary to provide clearance for the downward pivoting movement of supporting plate 40. The sling and winch 52 now lower the patient onto both of the supporting plates 38 and 40. The apparatus and the patient may now be moved away from the bed for transportating to another area and/or to change the bed linen.

The patient may be returned to the bed by reversing the order of the above described steps.

I claim:

1. Apparatus for lifting and transporting a patient comprising a base frame adapted to extend under a bed, said base frame having wheels for mobility, a vertical support structure mounted along one side of said base frame, said vertical support structure including a pair of fixed support posts attached to said base frame and further including a sliding support frame having telescoping support members around said posts, a pair of first and second patient supporting plates connected to said support structure, adjustment means to adjust said supporting plates vertically upon said support structure, said first supporting plate being positioned in a generally horizontal orientation and being adapted to be lowered onto the bed and slid partially under a prone patient, and pivot means to pivot said second supporting plate between an upper inoperative position and a lower operative position contiguous to said first supporting plate.

2. Apparatus according to claim 1, wherein said sliding support frame includes a main horizontal support member, a pair of depending vertical support members at the ends of said horizontal support member, and said pivot means including pivot arms connecting said second supporting plate to said vertical support members.

3. Apparatus for lifting and transporting a patient comprising a base frame adapted to extend under a bed, said base frame having wheels for mobility, a vertical support structure mounted along one side of said base frame, a pair of first and second patient supporting plates connected to said support structure, said supporting plates extending nearly the length of the bed, adjustment means to adjust said supporting plates vertically upon said support structure, said first supporting plate being positioned in a generally horizontal orientation and being adapted to be lowered onto the bed and slid partially under a prone patient, and pivot means to pivot said second supporting plate between an upper inoperative position and a lower operative position contiguous to said first supporting plate.

4. Apparatus for lifting and transporting a patient comprising a base frame adapted to extend under a bed, said base frame having wheels for mobility, a vertical support structure mounted along one side of said base frame, a pair of first and second patient supporting plates connected to said support structure, adjustment means to adjust said supporting plates vertically upon said support structure, said first supporting plate being positioned in a generally horizontal orientation and being adapted to be lowered onto the bed and slid partially under a prone patient, pivot means to pivot said second supporting plate between an upper inoperative position and a lower operative position contiguous to said first supporting plate, sling means to assist in positioning the patient upon said supporting plates and including a first portion to engage the shoulders of the patient and a second portion to engage the buttocks of the patient, and hoist means to raise and lower said sling means.

* * * * *